US007365626B2

(12) United States Patent
Matsutani et al.

(10) Patent No.: US 7,365,626 B2
(45) Date of Patent: Apr. 29, 2008

(54) MAGENTIC DEVICE

(75) Inventors: Nobuya Matsutani, Katano (JP); Tsunetsugu Imanishi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 19 days.

(21) Appl. No.: 10/959,645

(22) Filed: Oct. 6, 2004

(65) Prior Publication Data

US 2005/0073384 A1 Apr. 7, 2005

(30) Foreign Application Priority Data

Oct. 6, 2003 (JP) ..... 2003-346814

(51) Int. Cl.
*H01F 5/00* (2006.01)

(52) U.S. Cl. ..... 336/200; 336/232; 336/223

(58) Field of Classification Search ..... 336/200, 336/223, 175, 232
See application file for complete search history.

(56) References Cited

U.S. PATENT DOCUMENTS 6,356,181 B1 * 3/2002 Kitamura ..... 336/200
6,452,473 B1 * 9/2002 Suzuki et al. ..... 336/223
6,597,270 B2 * 7/2003 Takashima et al. ..... 336/83
6,990,725 B2 * 1/2006 Fontanella et al. ..... 29/602.1
2003/0048167 A1 * 3/2003 Inoue et al. ..... 336/200
2004/0263309 A1 * 12/2004 Ito et al. ..... 336/200

FOREIGN PATENT DOCUMENTS

| | | |
|---|---|---|
| JP | 61-136213 | 6/1986 |
| JP | 06-342714 | 12/1994 |
| JP | 08-037107 | 2/1996 |
| JP | 09-125108 | 5/1997 |
| JP | 2000-306731 A | 11/2000 |
| JP | 2001-326121 A | 11/2001 |

* cited by examiner

*Primary Examiner*—Anh Mai
(74) *Attorney, Agent, or Firm*—RatnerPrestia

(57) ABSTRACT

A magnetic device of smaller size and lower profile comprising a coil conductor of high inductance and low resistance is provided. The magnetic device comprises a coil conductor and a multilayer magnetic layer formed so as to cover the periphery of the coil conductor. Further, a magnetic device having higher inductance value and lower conductor resistance value (AC resistance) by selecting a magnetic layer capable of suppressing the eddy current and having excellent magnetic characteristics even designed with smaller size and lower profile.

12 Claims, 4 Drawing Sheets

MAGENTIC DEVICE

FIELD OF THE INVENTION

The present invention relates to a magnetic device used for inductors in electronic equipments.

BACKGROUND OF THE INVENTION

In recent years, along with a general trend of reducing the size and the thickness of electronic equipments, it has been strongly demanded to decrease the size and reduce the thickness of the electronic parts or power source devices used for them.

On the other hand, LSI, for example, in CPU have been improved in the operation speed and increased in the degree of integration and a high current is sometimes supplied to a power supply circuit for LSI. Accordingly, it is necessary for inductors such as choke coils used in the power source circuit described above to lower heat generation by decreasing the resistance of coil conductors and suffer from less lowering of the inductance value due to DC super impose (i.e., satisfactory DC superimposing characteristics).

Further, since the working frequency for them has become higher, it is also necessary that the loss in a high frequency region is low.

Further, since it has been strongly demanded for reducing the cost of parts, it is necessary that a device of a constitution with a simple shape can be assembled in a simple step. That is, it has been demanded to provide inductors or power source modules usable at high current and high frequency and reduced in the size and the thickness at a reduced cost. Among various kinds of parts used for the power source circuits, an inductor has a greatest thickness. In view of the above, it has been strongly demanded for reducing the thickness of a magnetic device such as an inductor in order to decrease the thickness of a power source module.

However, as the size of the magnetic device is decreased, the magnetic channel cross sectional area is generally decreased to lower the inductance value. An example of improving the characteristics of such a small sized magnetic device, i.e., a method of increasing the inductance value, is disclosed in Japanese Patent Laid-Open application No. S61-136213.

In this case, windings are applied to a flanged drum-shaped core material using ferrite or the like and then the inside of flanges is filled with a mixture of a magnetic powder and a resin to form a closed magnetic channel structure. In this structure, a bobbin usually used for windings is no more necessary to increase the magnetic channel cross sectional area by so much and attain a closed magnetic channel structure. As a result, the inductance value increases and the characteristic of the magnetic device is improved. However, the structure is intended for the size reduction of the magnetic device but not intended for the reduction of the thickness. Further, since the magnetic channel length in a mixture of the magnetic powder and the resin is long, it can not be said that sufficient characteristic can be obtained and it still leaves a subject.

Further, the ferrite material as a magnetic material used most generally has a relatively high permeability and a saturation magnetic flux density is lower compared with that of metal magnetic materials. As a result, when it is used as it is, the inductance lowers greatly by magnetic saturation tending to worsen the DC current superimpose characteristic. Then, for improving the DC superimposing characteristic, a gap is usually formed to a portion of the magnetic channel of a ferrite core thereby lowering the apparent permeability in use. However, since the saturated magnetic flux density is low, it is difficult to cope with high current.

Next, in a case of using, for example, an Fe—Si—Al alloy, Fe—Ni alloy, or the like having a saturation magnetic flux density higher than that of ferrite as the core material, since the metal materials described above have low electric resistance eddy current loss increases and, they can not be used as they are.

On the other hand, a dust core prepared by molding a metal magnetic powder has a remarkably high saturation magnetic flux density compared with a soft magnetic ferrite. Accordingly, this is excellent in the DC superimpose characteristics and advantageous in the size reduction. Further, since it is not necessary to provide a gap, it has a feature free from the problem of beats.

However, the dust core involves a problem that the core loss is large.

The core loss includes hysteresis loss and eddy current loss.

The eddy current loss increases in proportion with the square of frequency and square of the size in which the eddy current flows. Further, the dust core material is usually molded at a molding pressure of several tons/cm$^2$ or more. Accordingly, since the permeability is deteriorated along with increase in the distortion as the magnetic body, the hysteresis loss increases. In order to overcome the problem, occurrence of the eddy current is suppressed by covering the surface of a metal magnetic powder with an electrically insulating resin or the like. Further, for solving the problem of the hysteresis loss, strains are released by applying a heat treatment after molding. Examples of the countermeasures described above are disclosed, for example, in Japanese Patent Laid-Open Application Nos. H6-342714, H8-37107 and H9-125108.

However, for coping with further higher current, higher frequency and lower profile for power sources, the existent constitution involves a problem that it can not sufficiently insure the lower resistance, higher inductance value or high frequency characteristic of conductors.

The present invention intends to solve the foregoing subject and provides a magnetic device capable of obtaining a sufficient inductance value and an excellent in high frequency characteristic even when it is with smaller size and lower profile.

SUMMARY OF THE INVENTION

The present invention provides a magnetic device comprising a coil conductor, and a multilayer magnetic layer formed so as to cover the periphery of the coil conductor.

The invention further provides a magnetic device comprising a coil conductor, a connection terminal formed in contiguous with the coil conductor and a multilayer magnetic layer formed so as to cover the periphery of the coil conductor.

DETAILED DESCRIPTION OF THE PREFERRED EMBODIMENTS

Figure 1:
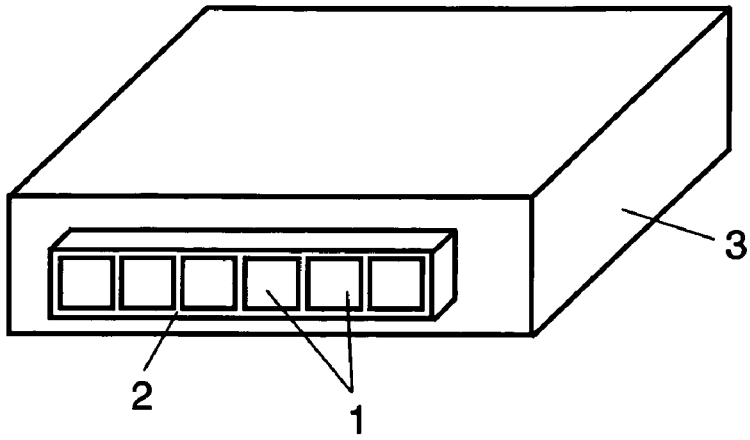
FIG. 1 is a perspective view of a magnetic device in a preferred Embodiment 1 according to the present invention and FIG. 1 includes a partially sectional view taken along line A-A in FIG. 2.

Preferred embodiments of the invention are to be described with reference to the drawings.

Identical components carry same reference numerals throughout the drawings for which detailed descriptions are to be omitted. Further, the drawings are schematic views and do not show dimensionally correct positions. Further, the conductor resistance value in the invention means both DC resistance value and AC resistance value.

Embodiment 1

Embodiment 1 is to be described with reference to FIG. 1, FIG. 2 and FIG. 3A to FIG. 3C.

The coil conductor 1 comprises conductors 8 made of a metal material having low resistance covered with an insulation film 2 arranged in plurality.

Figure 3A:
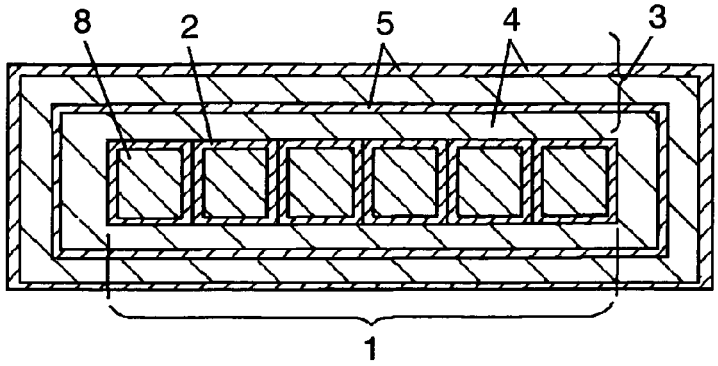
FIG. 3A and FIG. 3B are cross sectional views taken along lines B-B and C-C in FIG. 2 for a magnetic device according to Embodiment 1 of the invention.
Figure 3B:
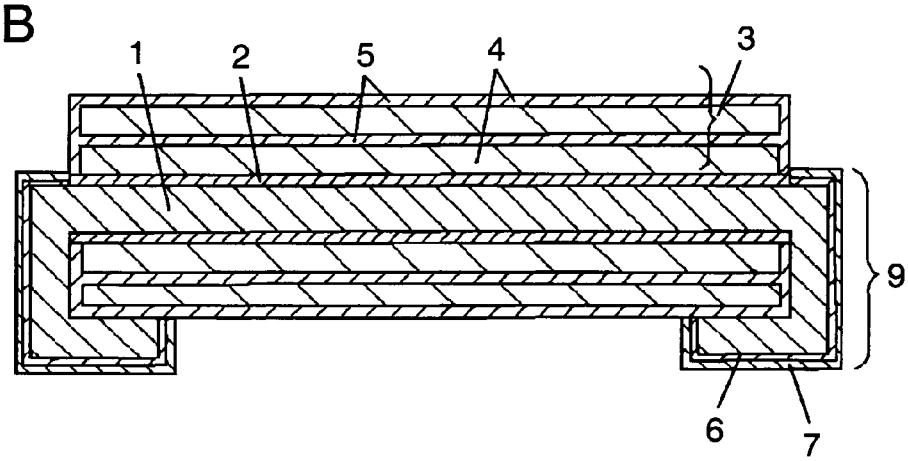
Figure 3C:
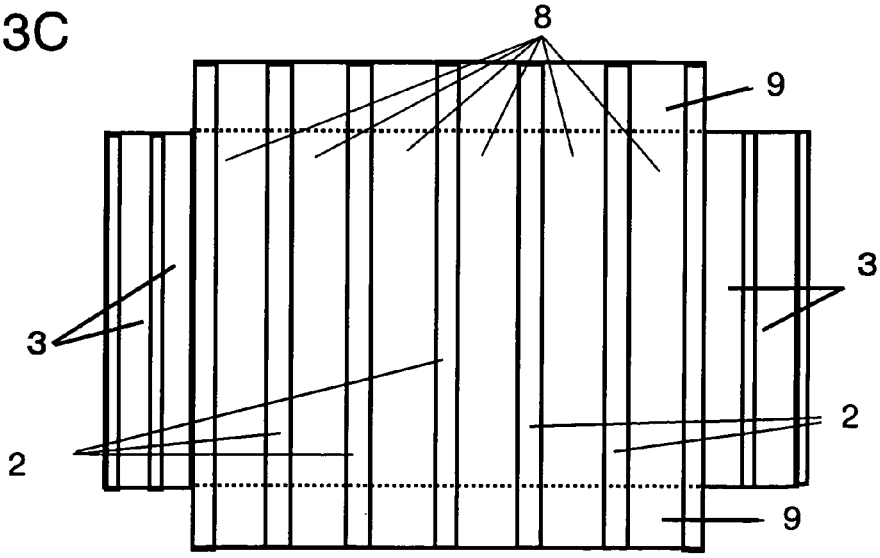
FIG. 3C is a plan view taken along line D-D in FIG. 2.

In FIG. 3A to FIG. 3C, conductors 8 each covered with the insulation film 2 are arranged to be parallel to C-C direction in the same plane.

In the present embodiment six conductors 8 are employed, however, the number of conductors may be changed.

The reason of using such a constitution is as described below.

Generally, in a case where the coil conductor 1 is constituted with one conductor 8 by fabricating a metal material having low resistance such as a copper sheet or a copper wire, the current flowing through the conductor 8 flows concentrically at the surface of the conductor 8 as the frequency is higher by the skin effect. As a result, an apparent resistance value (Rac) of the coil conductor 1 increases at a high frequency. Accordingly, for lowering the resistance value under the high frequency, while it is effective to increase the surface area without decreasing the cross sectional area of the coil conductor 1 but it is limited.

Accordingly, with the constitution of arranging plural conductors 8 each covered with the insulation film 2 can provide a coil conductor 1 capable of lowering the resistance value at the high frequency. The constitution can provide a coil conductor 1 capable of lowering the both DC resistance and the AC resistance. Further, it is effective to decrease the thickness or the width of the conductor 8. While different depending on the frequency used, the thickness or the width of the conductor 8 is preferably from 50 μm to 1 mm for the frequency assumed as from several hundreds kHz to several tens MHz.

The arrangement of coil conductor 1 can be selected properly with a view point of the size and shape and the performance of the device. That is, in a case where the lower profile is necessary, a plurality of conductors 8 are preferably arranged to be parallel each other in the same plane being parallel to the mounting surface. Further, the shape of the conductor 8 can be coped with in accordance with the design. Among them, since the rectangular shape can provide a design of the largest cross sectional area of the conductor 8 in a limited space, it is effective to lowering of the DC resistance (RdC). Further, for the conductor 8, it is preferred to use a straight punched metal, for example, a copper plate in view of the lowering of the resistance.

The multilayer magnetic layer (hereinafter referred to as MLM) 3 is formed to envelope coil conductor 1, for example, by a plating method. The MLM 3 has a multilayered structure in which a magnetic layer 4 formed, for example, of an Fe—Ni alloy magnetic material having a high saturation magnetic flux density and a high permeability, and an insulation layer 5 formed of an inorganic material or an organic material having an insulation property are stacked alternately. Such a constitution can provide a magnetic structure of excellent magnetic characteristic capable of satisfying high saturation magnetic flux density and high permeability and capable of coping with high current. Further, the constitution of the MLM 3 described above can provide excellent magnetic characteristic at high frequency.

Further, the thickness per one layer of the insulation layer 5, while depending on the specific resistivity value, is preferably from 0.01 μm to 5 μm. Further, while higher specific resistivity of the insulation layer 5 is more preferred, it is effective when the ratio of the specific resistivity relative to the magnetic layer 4 of $10^3$ or more. Further, an organic resin material or inorganic material such as a metal oxide is preferred as the insulation layer 5.

Figure 2:
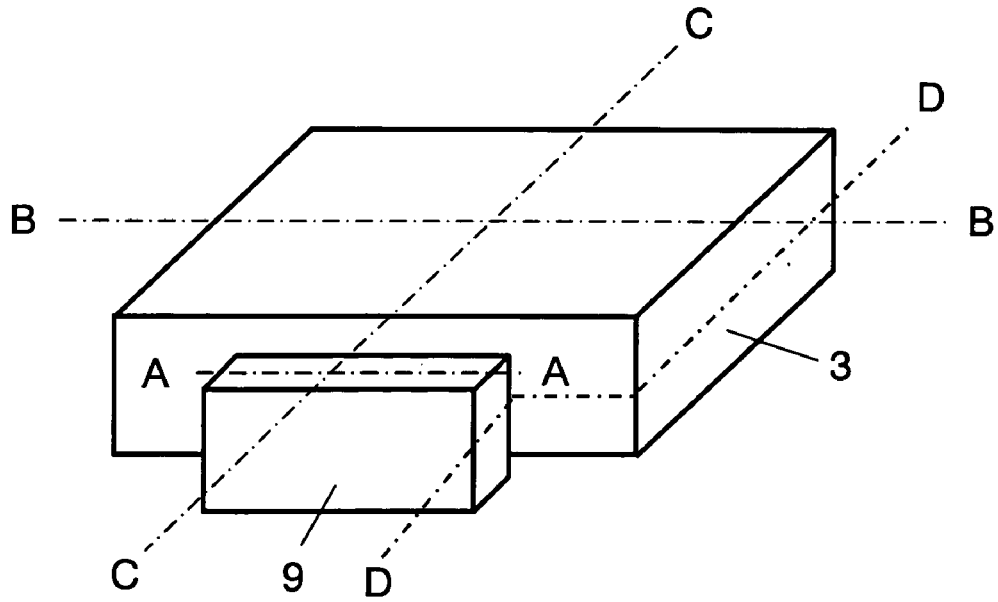
FIG. 2 is a perspective view of a magnetic device in Embodiments 1, 2 and 3 according to the present invention.

Further, as shown in FIG. 2 and FIG. 3B, a connection terminal 9 constituted so as to be in contiguous with the coil conductor 1 is provided.

The connection terminal 9 is indispensable for making the magnetic device as a surface mounting part. In a case of mounting the magnetic device to a circuit substrate such as a printed substrate, it is bonded to an electrode land of a circuit substrate by way of the connection terminal 9 by means of soldering or the like. As shown in this embodiment, connection terminal 9 is preferably consisted of the same material as conductor 8, however, the same material is not necessarily required.

As described above, by making the coil conductor 1 and the connection terminal 9 as a continuous body, resistance value due to joining can be excluded.

As a result, a magnetic device of lower resistance can be attained.

Further, for the constitution of the connection terminal 9, it is preferred to form a Ni layer as an underlying layer 6 on the conductor 8 and form a soldering layer or an Sn layer as outermost layer 7 with a view point of mounting.

Further, the mounting performance can be improved by forming the connection terminal 9 over at least two surfaces, that is, the exposed surface of the connection terminal 9 and the adjacent surface at the periphery thereof.

For example, a high density mounting of high reliability can be attained upon mounting to a circuit substrate or the like by bending the connection terminal 9 not only to the lateral surface but also to the lower surface of the magnetic device, as shown in FIG. 3B.

With the constitution described above, outermost layer 7 is formed also to the connection terminal 9 bent to the lower surface of the magnetic device. As a result, the magnetic device can be reliably mounted to the substrate circuit or the like.

The operation of the magnetic device having the constitution described above is to be explained.

When a high current (for example, 30 A) is supplied to the coils of the existent inductor, a magnetic flux is generated around the coil and a magnetic flux is generated in the direction of the plane of the magnetic body disposed so as to cover the coil. The thus generated magnetic flux generates an eddy current in the direction of the thickness of the body.

The eddy current acts to offset the magnetic flux generated in the direction of the magnetic body. As a result, inductance value in the inductor decreases.

Further, the eddy current generated in the direction of the thickness of the magnetic body also causes heat generation from the inductor.

However, since the magnetic device in this embodiment is formed with the MLM 3 so as to cover the periphery of the coil conductor 1, the cross sectional area in the direction of the thickness per single magnetic layer 4 constituting the MLM 3 is sufficiently small relative to the eddy current. Accordingly, generation of the eddy current generated in the direction of the thickness of the MLM 3 can be suppressed.

As a result, this can prevent offset of the magnetic flux generated in the direction of the plane of the MLM 3, and the reduction in inductance value of the magnetic device can be suppressed. In addition, generation of heat from the magnetic device can also be suppressed.

Further, the magnetic layer 4 constituting the MLM 3 can be formed easily as a continuous film uniformly at the periphery of the coil conductor 1 under control for the film thickness being formed by a plating method.

As has been described above, a magnetic device of sufficiently high inductance can be obtained with such a constitution even when designed with smaller size and lower profile. Further, the magnetic layer 4 can be formed at a good productivity by the advantageous feature of the plating method. The magnetic layer 4 may also be formed by sputtering or vapor deposition. However, the method described above can form only one surface of the coil conductor 1 by one step of film forming operation and, further, it is difficult to form a magnetic layer 4 having a uniform film thickness in continuous over four surfaces of the coil conductor 1 with a view point of the productivity. Accordingly, it is preferred to form the magnetic layer by the wet process plating method with the view point of productivity and the characteristic of the layer.

The magnetic layer 4 is preferably consisted of metal system magnetic material having at least one of Fe, Ni, and Co as a main composition for at least one layer.

As a result, it is possible to obtain a magnetic layer 4 of excellent magnetic characteristic capable of satisfying high saturation magnetic flux density and high permeability capable of coping with high current and attain high inductance.

Further, the thickness per one layer of the magnetic layer 4 is different depending on the frequency. Assuming the frequency as several hundreds of kHz to several tens of MHz, the thickness is preferably from 1 μm to 50 μm.

Further, the insulation layer 5 can be formed from a metal oxide or an organic insulation material by the method, for example, of electrodeposition. The thickness per one layer of the insulation layer 5 is preferably from 0.01 μm to 5 μm while depending on the specific resistivity value. Further, while it is preferred that the specific resistivity value of the insulation layer 5 is higher, it has been confirmed that the effect can be obtained when the ratio of the specific resistivity value relative to the magnetic layer 4 is $10^3$ or more.

As described above, a magnetic device having sufficiently large inductance value and excellent in the high frequency characteristic can be obtained even when the size is reduced and the profile is lower.

Embodiment 2

Figure 4:
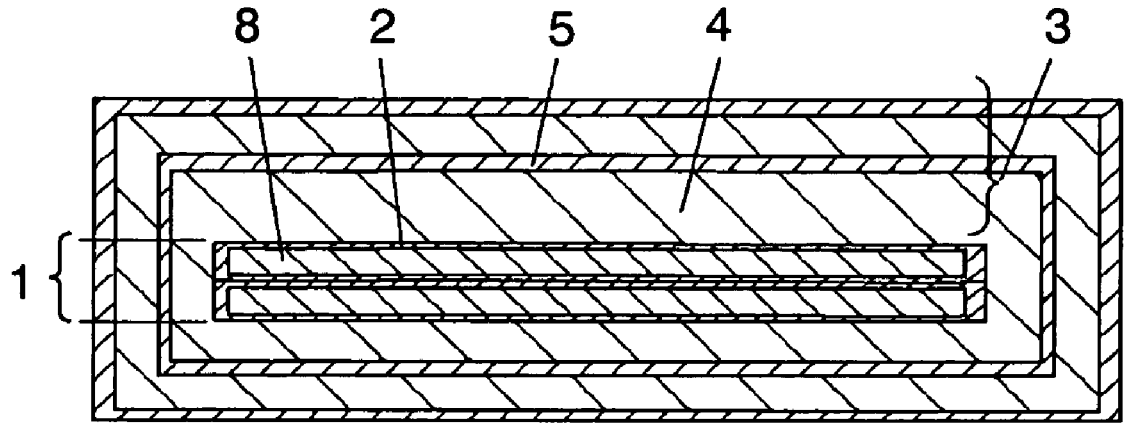
FIG. 4 is a cross sectional view taken along line B-B in FIG. 2 of a magnetic device in Embodiment 2 of the invention.
Figure 5:
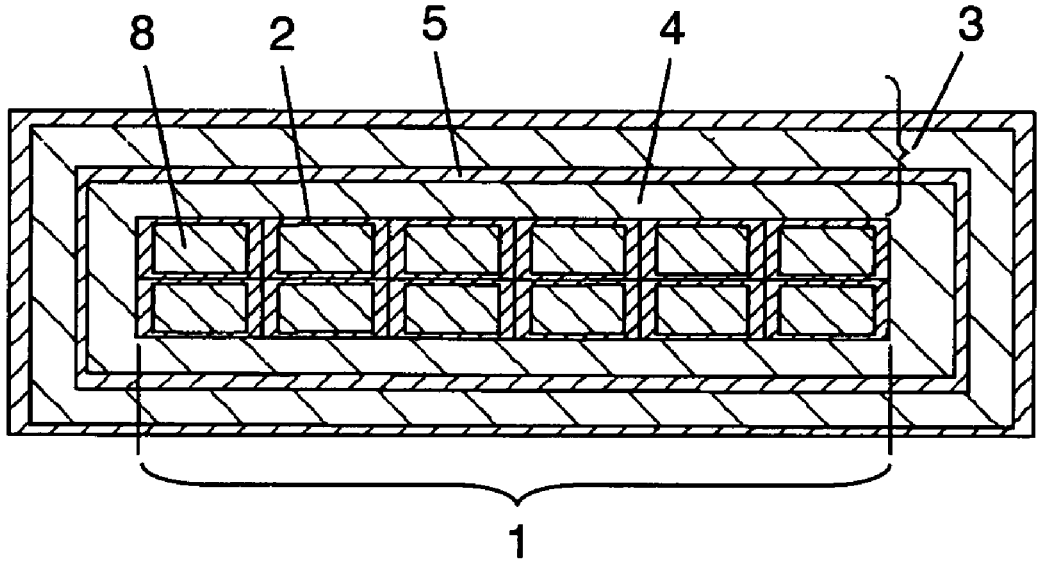
FIG. 5 is a cross sectional view taken along line B-B in FIG. 2 of another magnetic device in Embodiment 2 of the invention.

Description is to be made to Embodiment 2 with reference to FIG. 2, FIG. 4 and FIG. 5.

The constitutions identical with those in Embodiment 1 carry the same reference numerals for which detailed descriptions will be omitted. Conductors 8 of a coil conductor 1 are covered each with insulation film 2. A coil conductor 1 shown in FIG. 4 is constituted with two stacked conductor layers. The conductor layer includes conductors 8 having rectangular cross sectional shapes are arranged in the same plane being parallel to the mounting surface.

A coil conductor 1 shown in FIG. 5 is different from FIG. 4 in that conductors 8 are arranged in the parallel direction to line D-D shown in FIG. 2.

The material for the conductor 8 is preferably copper, silver or aluminum of low specific resistivity, or it may be an alloy containing them. Further, the insulation film layer 2 electrically insulates each of the conductors 8.

Since a connection terminal 9 is formed contiguous with the coil conductor 1, it is free from increase or scattering of the resistance value caused by soldering in the connection terminal 9, and low resistance can be attained stably.

The connection terminal 9 is preferably formed of a Ni layer as an underlying layer 6 on the coil conductor 1 and a solder layer or an Sn layer as outermost layer 7. With this constitution, since soldering is formed also to the connection terminal 9 bent to the lower surface of the magnetic device, the magnetic device can be mounted reliably to a substrate or the like.

Since the connection terminal 9 is bent not to the lateral surface but to the lower surface of the magnetic device, each of the portions can be mounted at high density upon mounting to the substrate or the like.

Further, since the underlying layer 6 is formed to the connection terminal 9 and outermost layer 7 is formed thereover, oxidation of the underlying layer 6 can be prevented. As a result, a magnetic device at high reliability of more excellent solder wettability can be attained.

The MLM 3 is formed, for example, by plating. The MLM 3 comprises a stacked body consisting of a magnetic layer 4 and an insulation layer 5.

The operation of the magnetic device having the foregoing constitution is to be described.

When a high current is supplied to the coil conductor 1, a strong magnetic flux is generated in the magnetic device to generate a magnetic flux in the direction of the plane of the MLM 3 formed so as to cover the coil conductor 1. As has been described for Embodiment 1, since MLM 3 is formed of a magnetic layer 4 stacked in multi-layers, the cross sectional area of the magnetic layer 4 in the direction of the thickness per one layer of MLM 3 is sufficiently small relative to the eddy current. Accordingly, eddy current generated in the direction of the thickness of the MLM 3 can be suppressed. As a result, since the offset of the magnetic flux generated in the generation of the plane of the MLM 3 can be prevented, the inductance of the magnetic device can be increased.

The main composition for the magnetic layer 4 for at least one layer in the MLM 3 preferably contains at least one of Fe, Ni, and Co. In this way, it is possible to obtain a magnetic layer of excellent magnetic characteristic capable of satisfying high saturation magnetic flux density and high permeability and capable of coping with a high current and provide a high inductance.

The thickness per single magnetic layer 4 is different depending on the frequency, and assuming the frequency as several hundreds of kHz to several tens of MHz, the thickness is preferably from 1 μm to 50 μm.

Further, the thickness per one layer of the insulation layer 5 is preferably from 0.01 μm to 5 ρm while depending on the specific resistivity value.

Further, while it is preferred that the specific resistivity value of the insulation layer 5 is higher, the effect can be obtained when the ratio of the specific resistivity value relative to the magnetic layer 4 is $10^3$ or more.

For the insulation layer 5, an organic resin material or an inorganic material such as a metal oxide is preferred.

Further, since the current flowing to the conductor 8 flows only to the surface of the conductor as a frequency is higher due to the skin effect, an apparent resistance (Rac) is increased at higher frequency.

Accordingly, for lowering the resistance at high frequency, it is effective to reduce the thickness or the width of the conductor 8. The thickness or the width of the conductor 8 is preferably from 50 μm to 1 mm assuming the working frequency as from several hundreds of kHz to several tens of MHz, while different depending on the frequency.

Further, as shown in FIG. 5, in a case of forming a coil conductor 1 by arranging conductors 8 formed by dividing in the parallel direction and the vertical direction relative to the mounting surface, AC resistance can be decreased further in the magnetic device. As a result, a magnetic device of excellent high frequency characteristic can be obtained.

For the insulation film 2 covering the conductors 8, it is preferred to use a material having at least one member selected from the group consisting of organic resin material, metal oxide and glass with a view point of voltage withstanding between the conductors 8 and the reliability. The thickness of the insulation film 2 is preferably within a range from 0.005 to 0.075 mm with a view point of voltage withstanding and the reliability. When the thickness of the insulation film 2 is less than 0.005 mm, a withstanding voltage is poor.

When the thickness of the insulation film 2 exceeds 0.075 mm, a magnetic characteristic becomes low.

As described above according to Embodiment 2, a magnetic device of sufficiently high inductance and low AC resistance value can be obtained even when it is designed with smaller size and lower profile.

Embodiment 3

Embodiment 3 is to be described with reference to FIG. 2 and FIG. 6.

Figure 6:
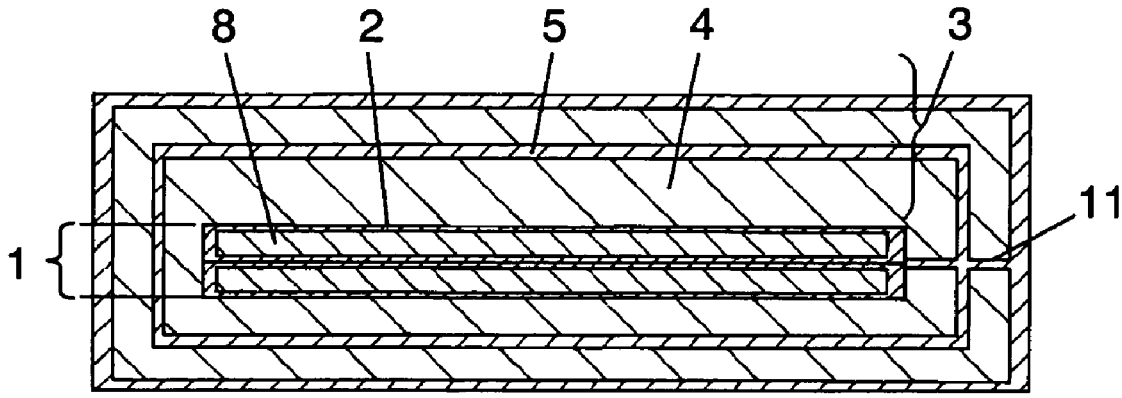
FIG. 6 is a cross sectional view taken along line B-B in FIG. 2 of a magnetic device in Embodiment 3 according to the invention.

As shown in FIG. 2 and FIG. 6, a coil conductor 1 of a magnetic device comprises two rectangular conductors 8 formed by dividing in the vertical direction relative to the mounting surface. Further, since the basic constitution of this embodiment is identical with those of Embodiments 1 and 2, detailed descriptions therefor will be omitted.

However, this is different from Embodiments 1 and 2 in that a slit 11 is formed in the magnetic layer 4 cutting the magnetic layer 4. The slit 11 can be filled with an insulating material. The slit 11 can suppress the saturation of the magnetic flux and improve the DC superimpose characteristic.

The operation of the magnetic device having the foregoing constitution is to be described below.

When a high current is supplied to the coil conductor 1, a strong magnetic flux is generated in the magnetic device to generate a magnetic flux in the direction of the plane of the MLM 3 formed so as to cover the coil conductor 1. As has been described for Embodiments 1 and 2, since the coil conductor 1 is formed of a magnetic layer 4 in multi-layers so as to cover the periphery of the conductor 8, the cross sectional area of the magnetic layer 4 in the direction of the thickness per one layer of MLM 3 is sufficiently small relative to the eddy current. Accordingly, eddy current generated in the direction of the thickness of the MLM 3 can be suppressed. As a result, since offset of the magnetic flux generated in the generation of the plane of the MLM 3 can be prevented, the inductance of the magnetic device can be increased.

Further the main composition for the magnetic layer 4 for at least one layer of the MLM 3 preferably contains at least one of Fe, Ni, and Co. As a result, it is possible to obtain a magnetic layer of excellent magnetic characteristic capable of satisfying high saturation magnetic flux density and high permeability and capable of coping with a high current and provide a high inductance.

Since the slit 11 formed in the magnetic layer 4 can suppress the saturation of the magnetic flux in the MLM 3, the DC superimpose characteristic of a high current can be improved more.

While the thickness per one layer of the magnetic layer 4 is different depending on the frequency, assuming the frequency as several hundreds of kHz to several tens of MHz, the thickness is preferably from 1 μm to 50 μm. The thickness per one layer of the insulation layer 5 is preferably from 0.01 μm to 5 μm while depending on the specific resistivity value. Further, while it is preferred that the specific resistivity value of the insulation layer 5 is higher, the effect can be obtained when the ratio of the specific resistivity relative to the magnetic layer 4 is $10^3$ or more.

As has been described above, according to the magnetic device of Embodiment 3, it is possible to obtain a magnetic device having a sufficiently high inductance even when the size is made smaller and the profile is made lower and having more excellent DC superimpose characteristic.

The advantageous features of the magnetic device according to the invention are summarized as below.

The magnetic device according to invention comprises a coil conductor and an MLM formed so as to cover the periphery of the coil conductor.

This can suppress the eddy current generated in the magnetic layer and provide a magnetic layer having excellent magnetic characteristic, and can provide a magnetic device having a sufficiently high inductance value even when the size is made smaller and the profile is made lower.

Further, the magnetic device according to the invention comprises a coil conductor, a connection terminal formed in contiguous with the coil conductor and a continuous body, and an MLM formed so as to cover the periphery of the coil conductor.

This can provide a magnetic device of low conductor resistance excellent in the mounting performance in addition to the advantageous features described above.

The magnetic device according to the invention is a magnetic device using a coil conductor constituted with plural conductors each covered with an insulation film which can reduce the increase of the conductor resistance at high frequency due to the skin effect and provide excellent characteristic even at high frequency.

The magnetic device according to the invention has a rectangular cross sectional shape for the conductor and since this can provide a coil of high space factor, smaller size and lower profile can be attained.

In the magnetic device according to the invention, the conductor is formed of copper, silver, aluminum, or an alloy thereof. This can attain a lower resistance value.

The magnetic device according to the invention is a magnetic device in which the insulation film for the conductor is at least one member selected from the group consisting of organic resin material, metal oxide and glass. This can reliably insulate the conductors from each other.

In the magnetic device according to the invention, the thickness of the insulation film for the conductor is from 0.005 to 0.075 mm. This can reduce the increase of the conductor resistance at high frequency (skin effect) to provide excellent characteristic even at high frequency.

In the magnetic device according to the invention, the coil conductor is comprised of plural conductors each covered with an insulation film and arranged in the parallel relative to the mounting surface. This can reduce the increase of the conductor resistance value at high frequency to provide excellent characteristic even at high frequency.

In the magnetic device according to the invention, the coil conductor is comprised of plural conductors each covered with an insulation film and arranged in the vertical direction of the mounting surface. This can reduce the increase of the conductor resistance value at high frequency to provide excellent characteristic even at high frequency.

In the magnetic device according to the invention, the coil conductor is comprised of plural conductors each covered with an insulation film and arranged both in the parallel direction and the vertical direction of the mounting surface. This can reduce the increase of the conductor resistance value at high frequency to provide excellent characteristics even at high frequency.

In the magnetic device according to the invention, the MLM is constituted by stacking the magnetic layer and the insulation layer alternately. This can suppress the eddy current, and, by selecting a magnetic layer having an excellent magnetic characteristic, a magnetic device of a sufficiently high inductance can be provided even in a case of reducing the size and lowering the profile.

In the magnetic device according to the invention, the MLM has a constitution of forming the slit in at least one of the magnetic layers. This can provide excellent DC superimpose characteristic with less magnetic saturation.

The magnetic device according to the invention is constituted with MLM with at least one magnetic layer being formed by the plating method. This can provide a magnetic device having a magnetic layer of excellent magnetic characteristic and having a sufficiently high inductance value even in a case of reducing the size and lowering the profile.

In the magnetic device according to the invention, at least one magnetic layer in the MLM has a main composition comprising at least one member selected from the group consisting of Fe, Ni and Co. This can provide a magnetic layer having excellent magnetic characteristic and a magnetic device having a sufficiently high inductance value even in a case of reducing the size and lowering the profile.

In the magnetic device according to the invention, the connection terminal is formed over at least two surfaces, that is, a bottom surface and an adjacent surface at the periphery thereof. This can provide a magnetic device excellent in high density mounting performance and the reliability.

In the magnetic device according to the invention, at least a portion of the connection terminal exposed to the surface is comprised of a Ni layer as an underlying layer and a soldering layer or an Sn layer as the outermost layer. This can provide a magnetic device of excellent solder wettability and reliability.

The present invention provides a magnetic device of sufficiently high inductance and low conductor resistance value even in a case of reducing the size and lowering the profile. Accordingly, this is applicable generally as a magnetic device which can be used for inductors and the like of electronic equipments intended for the reducing size and thickness.

What is claimed is:

1. A magnetic device comprising:

a member made up of a linear coil conductor and a connection terminal which is connected with the coil conductor at both ends of the coil conductor, wherein the member is C-shaped composing the connection terminal which is bent to a lateral surface and to a lower surface of the magnetic device, at the plane vertical to a mounting surface and parallel to the coil conductor; and a magnetic layer formed so as to cover a periphery of the coil conductor, wherein the coil conductor includes plural conductors each covered with an insulation film.

2. A magnetic device according to claim 1, wherein the multilayer magnetic layer is formed by a plating method for at least one of magnetic layers.

3. A magnetic device according to claim 1, wherein the least one magnetic layer has at least one element formed from a material selected from the group consisting of Fe, Ni, and Co as a main composition.

4. A magnetic device according to claim 1, wherein the cross sectional shape of the conductor is rectangular.

5. A magnetic device according to claim 1, wherein the conductor is one member selected from the group consisting of copper, silver, aluminum or alloy thereof.

6. A magnetic device according to claim 1, wherein the insulation film has at least one member selected from the group consisting of an organic resin material, metal oxide and glass.

7. A magnetic device according to claim 1, wherein the thickness of the insulation film is from 0.005 to 0.075 mm.

8. A magnetic device according to claim 1, wherein the coil conductor is constituted with plural conductors each covered with an insulation film and arranged in the parallel direction relative to the mounting surface.

9. A magnetic device according to claim 1, wherein the coil conductor is constituted with plural conductors each covered with an insulation film and arranged in the vertical direction relative to the mounting surface.

10. A magnetic device according to claim 1, wherein the coil conductor is constituted with plural conductors each covered with an insulation film and arranged in the parallel direction and the vertical direction relative to the mounting surface.

11. A magnetic device according to claim 1, further comprising a multilayer magnetic layer constituted by stacking at least one magnetic layer and at least one insulation layer alternately.

12. A magnetic device according to claim 11, wherein the multilayer magnetic layer has a slit in at least one of the magnetic layers.

* * * * *

UNITED STATES PATENT AND TRADEMARK OFFICE

CERTIFICATE OF CORRECTION

PATENT NO. : 7,365,626 B2
APPLICATION NO. : 10/959645
DATED : April 29, 2008
INVENTOR(S) : Nobuya Matsutani et al.

It is certified that error appears in the above-identified patent and that said Letters Patent is hereby corrected as shown below:

On the Title Page, Item [54], Title, and at Column 1, line 1, “MAGENTIC DEVICE” should read -- MAGNETIC DEVICE --

Signed and Sealed this

Second Day of June, 2009

JOHN DOLL
*Acting Director of the United States Patent and Trademark Office*